US005706536A

United States Patent [19]

Krauska

[11] Patent Number: 5,706,536

[45] Date of Patent: Jan. 13, 1998

[54] LATCH MECHANISM FOR ARTICULATED BEDS AND THE LIKE

[75] Inventor: Bernard Krauska, Stevens Point, Wis.

[73] Assignee: Joerns Healthcare Inc., Stevens Point, Wis.

[21] Appl. No.: 572,304

[22] Filed: Dec. 14, 1995

[51] Int. Cl.[6] ..... A61G 7/015

[52] U.S. Cl. ..... 5/618

[58] Field of Search ..... 5/613, 616, 617, 5/618, 619

[56] References Cited

U.S. PATENT DOCUMENTS

| | | | |
|---|---|---|---|
| 392,009 | 10/1888 | Cleveland . | |
| 1,206,536 | 11/1916 | Hill . | |
| 1,218,519 | 3/1917 | Bradley . | |
| 1,902,249 | 3/1933 | Lanzy . | |
| 2,026,153 | 12/1935 | Wright et al. . | |
| 2,968,050 | 1/1961 | Shankman . | |
| 3,061,843 | 11/1962 | Singer et al. . | |
| 3,974,530 | 8/1976 | Lusch et al. . | |
| 4,005,497 | 2/1977 | Sutter . | |
| 4,043,219 | 8/1977 | Schätti | 297/377 |
| 4,346,487 | 8/1982 | Holdt et al. . | |

*Primary Examiner*—Alexander Grosz
*Attorney, Agent, or Firm*—Price, Heneveld, Cooper, DeWitt & Litton

[57] ABSTRACT

A simple, inexpensive ratchet type latch mechanism for maintaining a movable portion of an articulated structure in an elevated position relative to a stationary portion of the structure on which the movable portion is pivotably mounted. The latch mechanism includes a ratchet plate pivotally mounted at one end thereof to the stationary portion of the structure and has an elongate ratchet slot with a plurality of ratchet notches, an escapement plate slidably mounted to the ratchet plate for movement between a first position wherein the ratchet notches are exposed, and a second position wherein the ratchet notches are covered. A crank arm is pivotally connected at one end to the movable portion of the structure and has a pin at another end thereof which projects from the crank and through the slot in the ratchet and through the slot in the escapement plate. The pin is engagable with a cam surface at one end of the slot in the escapement plate to move the escapement plate to a set position wherein the ratchet notches are exposed. The pivotable portion can be raised to any of a plurality of discrete elevated positions wherein the clevis pin engages one of the ratchet notches to support the pivotable portion in a corresponding elevated position. When the clevis pin is moved passed the ratchet notches corresponding to the most elevated position in which the pivotable portion can be maintained by the mechanism, the pivot pin engages the cam surface at the end opposite of the first cam surface to cause the escapement plate to move to the reset position wherein the ratchet notches are covered by the escapement plate to allow the pivotable portion to be lowered unimpeded by the ratchet notches. As the pivotable portion is translated downwardly to its lowest position, the clevis pin again engages the first cam surface causing the escapement plate to move back to the set position wherein the ratchet notches are again exposed to reconfigure latch mechanism so that the pivotable portion can be again raised and held in an elevated position by the engagement of the pin with the ratchet notches.

20 Claims, 4 Drawing Sheets

LATCH MECHANISM FOR ARTICULATED BEDS AND THE LIKE

BACKGROUND OF THE INVENTION

This invention relates to articulated beds and other similar structures, and in particular to a latch mechanism for maintaining a movable portion of an articulated bed or the like in an elevated or raised position relative to a stationary portion of the structure.

Various mechanisms have been utilized on adjustable, multiple position beds, stretchers, other motion furniture and the like, for maintaining a portion thereof in a raised position. The most commonly utilized means for maintaining one section of an articulated bed or the like in a raised position is a screw drive mechanism. Screw drive mechanisms comprise a plurality of machined components including an externally threaded shaft or screw, a drive nut which threadingly engages the external threads of the screw, and a drive shaft operatively connected to the drive nut. Because of the precise tolerances needed to insure proper operation, such screw drive mechanisms are relatively expensive to manufacture. Screw drive mechanisms also require a relatively long mounting distance in order to achieve the desired translation of the portion of an articulated structure which is to be raised, thereby requiring relatively high material expenditures, in addition to high machining and assembly costs. Another disadvantage with the screw drive mechanisms is that considerable time and effort is required to manually crank the screw to translate a portion of the bed or other articulated structure to the desired raised position. Accordingly, screw drive mechanisms are preferably utilized in conjunction with an electric motor, further increasing the cost associated with their use.

Various ratchet type latch mechanisms have also been utilized. Such mechanisms are, for example, disclosed by Cleaveland (U.S. Pat. No. 392,009), Lanzy (U.S. Pat. No. 1,902,249), and Shankman (U.S. Pat. No. 2,968,050). Known ratchet type latch mechanisms normally have several disadvantages. For example, the known ratchet type latch mechanisms cannot be easily retrofitted to existing care beds or the like. For instance, the mechanism described by Cleaveland would require mounting the latch and plate to separate components, and would not permit through bolting or pinning to a bed frame or the like. Likewise, the mechanism described by Lanzy does not permit through bolting or pinning to a care bed frame or the like. Shankman describes a relatively complicated mechanism which requires a secondary action by a lever to disengage the latch, resulting in a relatively expensive and difficult to use mechanism.

Therefore, there remains a need for a simple, inexpensive ratchet type latch mechanism for care beds and the like, which has fewer components, is easier to position than known mechanisms, can be more quickly positioned as compared with the screw drive mechanisms, is retrofitable with existing positioner designs, has a shorter mounting distance, is easier to assemble, and requires less effort to manipulate.

SUMMARY OF THE INVENTION

The invention provides a simple, inexpensive ratchet type latch mechanism for maintaining a movable portion of an articulated structure in an elevated position relative to a stationary portion on which the movable portion is pivotally mounted. The mechanism includes a ratchet plate pivotally mounted to the stationary portion of the structure and has an elongate ratchet slot with a plurality of longitudinally spaced ratchet notches, an escapement plate slidably mounted to the ratchet plate and having an elongate slot generally overlying the ratchet slot. The escapement plate is movable with respect to the ratchet plate between a first position wherein the ratchet notches are exposed and a second position wherein the ratchet notches are covered. A crank arm is pivotally connected at one end to the movable portion of the structure and has a pin at another end thereof which projects laterally from the lever and through the slot in the ratchet and through the slot in the escapement plate. The pin is engagable with a cam surface at one end of the slot in the escapement plate to move the escapement plate to the set position wherein the ratchet notches are exposed when the pivotable portion is lowered. When the ratchet notches are exposed, the pivotable portion can be raised to any of a plurality of discrete elevated positions wherein the clevis pin engages one of the ratchet notches to support the pivotable portion in a corresponding position. Translating the clevis pin through the elongate slots will permit the clevis pin to consecutively catch in each latch position. When the clevis pin is moved past the ratchet notch corresponding to the most elevated position in which the pivotable portion can be maintained by the mechanism, the pivot pin engages a cam surface at the end opposite of the first cam surface to cause the escapement plate to move to a reset position wherein the ratchet notches are covered by the escapement plate to allow the pivotable portion to be lowered unimpeded by the ratchet notches. As the pivotable portion is translated downwardly to its lowest position, the pin again engages the first cam surface to move the escapement plate to the set position wherein the ratchet notches are again exposed to reconfigure the latch mechanism so that the pivotable portion can be again raised and held in an elevated position.

DESCRIPTION OF THE PREFERRED EMBODIMENT

Figure 1:
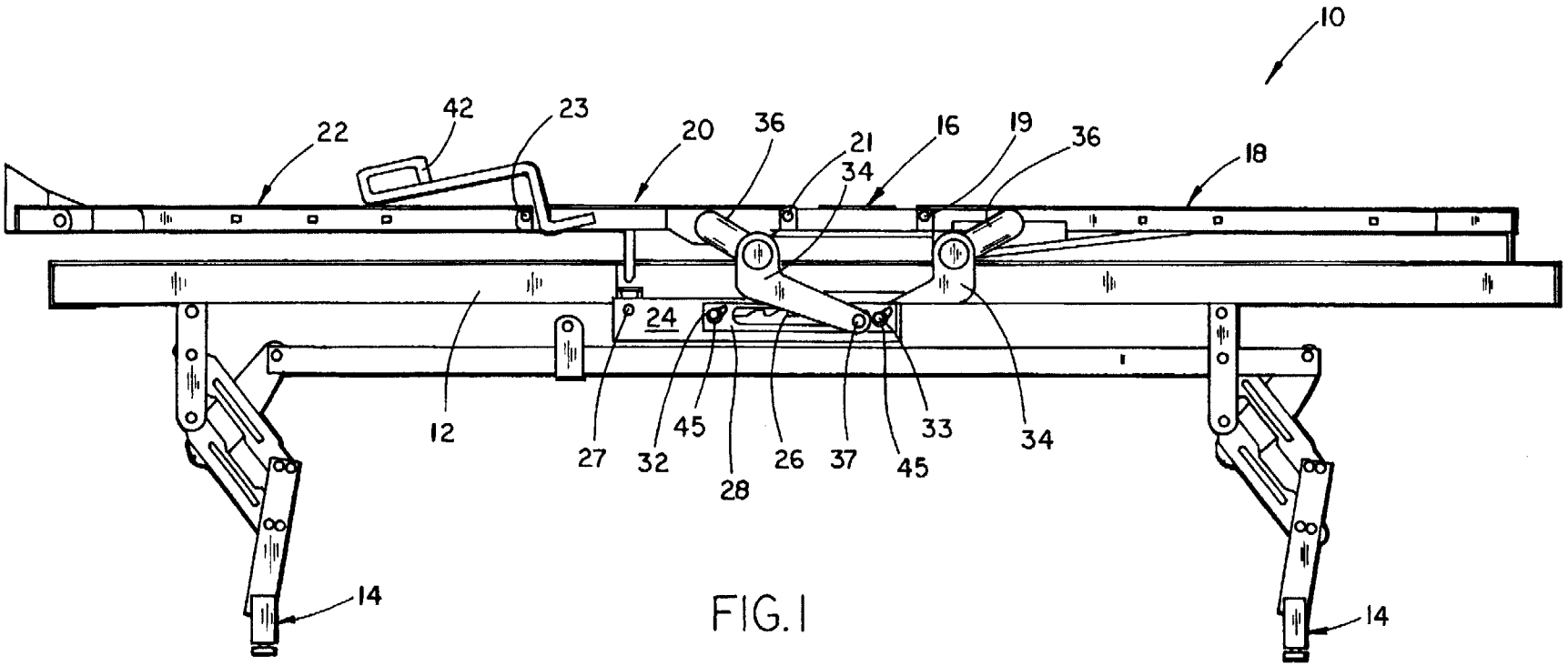
FIG. 1 is a side elevational view of an articulated, adjustable, multiple positioned care bed employing the ratchet type latch mechanism of the invention.

In FIG. 1, there is shown an articulated, adjustable, multiple position care bed 10. Articulated bed 10 is of generally conventional design and includes a frame 12 having a plurality of legs 14. Legs 14 are typically foldable. Bed 10 includes a seat section 16 which is stationarily mounted to frame 12 in a conventional manner. Bed 10 also includes a back section 18 which is pivotally connected to the forward edge of seat section 16 for rotation about pivot axis 19, a knee section 20 which is pivotally mounted to the rear edge of seat section 16 for rotation about pivot axis 21, and a foot section 22 which is pivotally mounted to the rear edge of knee section 20 for rotation about pivot axis 23.

The ratchet type latch mechanism of the invention will be described with reference to its use in maintaining knee section 20 in any of a plurality of elevated positions. However, it is to be understood that the embodiment shown in the Figures and described herein is merely illustrative of the invention, the invention being generally useful for maintaining a pivotable portion of a variety of different structures in an elevated position relative to a base or frame on which the pivotable portion is pivotally mounted. As an example, the ratchet type latch mechanism of the invention can be utilized with articulated beds having fewer or more articulated portions, as well as with stretchers, chairs or other motion furniture and the like. For beds or the like having a plurality of pivotally mounted portions, the latch mechanism of the invention can be used with any or all of the pivotable portions as desired.

The latch mechanism includes a ratchet plate 24 (FIGS. 2–7) having an elongate slot 25 with a plurality of ratchet notches 26. Ratchet plate 24 is pivotally mounted to frame 12 at one end thereof for rotation about pivot axis 27. Ratchet plate 24 can be provided with generally any desired number of ratchet notches 26 which correspond to the desired number of discreet positions in which knee section 20 can be elevated.

Figures 2, 5:
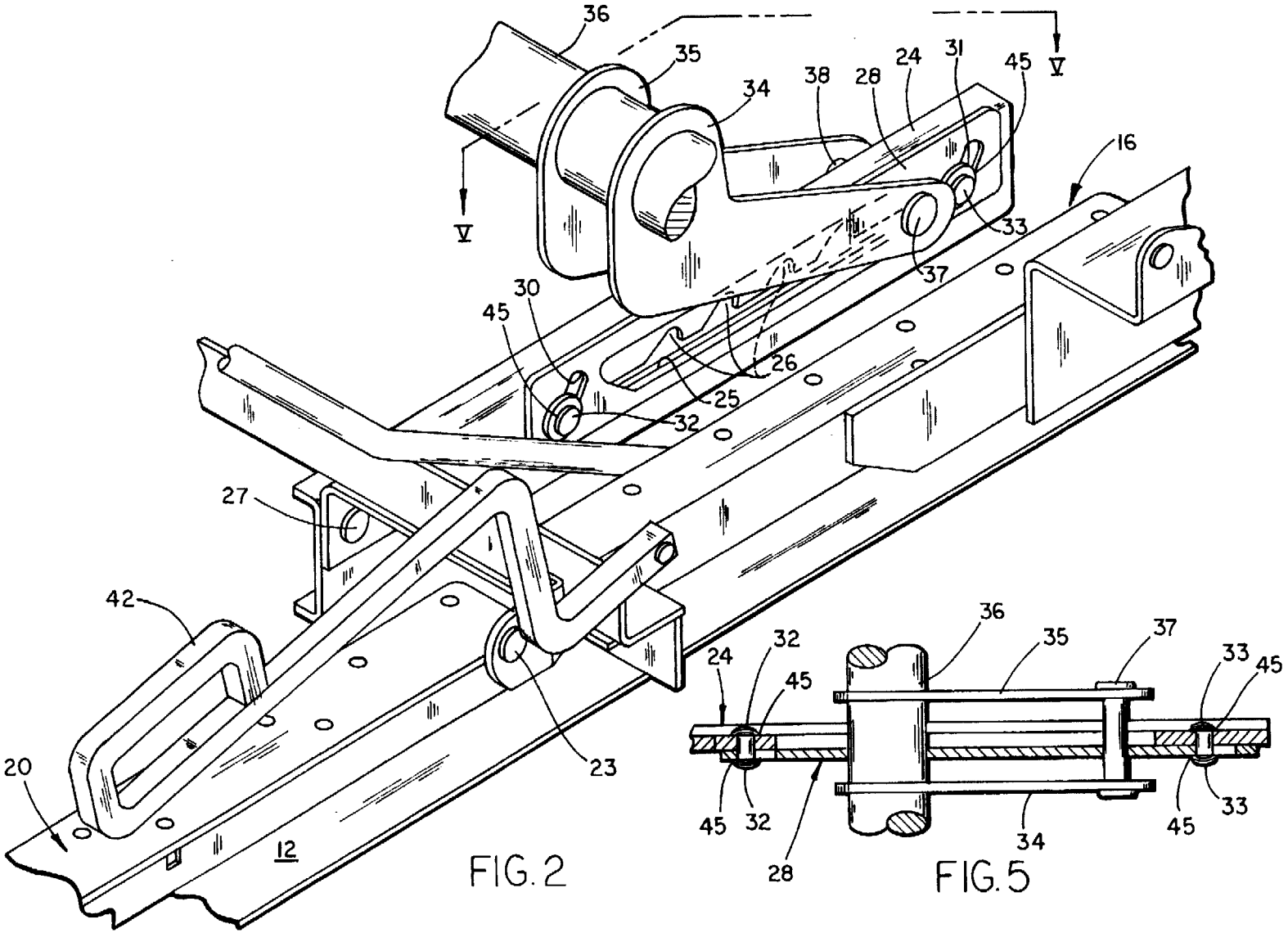
FIG. 2 is an enlarged, fragmentary perspective view of the latch mechanism.
FIG. 5 is a top plan view, partially in cross-section, of the latch mechanism, as viewed along lines V—V of FIG. 2.
Figure 7:
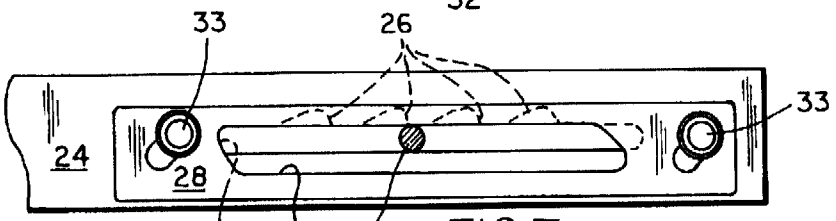
FIG. 7 is an enlarged, fragmentary, side elavational view of the latch mechanism reset in the position showing a clevis pin engaging the upper end of an elongate slot in the escapement plate to allow the elevated portion of the articulated bed to be lowered, impeded by the ratchet notches.

An escapement plate 28 is movably mounted to ratchet plate 24. Escapement plate 28 includes an elongate slot 29 which is generally in alignment with and overlaps elongate slot 25 in ratchet plate 24. In the illustrated embodiment, slot 29 has a length which is substantially equal to that of slot 25, and a width or height which is substantially equal to the maximum height or width of slot 25 as measured from the lower side of slot 25 to the upper extremity of one of the ratchet notches 26. Escapement plate 28 includes at each end thereof a relatively short diagonal slot 30 and 31 through which retainer pins 32 and 33 pass for movably mounting escapement plate 28 to ratchet plate 24. In the illustrated embodiment, retainer pins 32 and 33 can be a rivet, bolt or the like which generally maintains escapement plate 28 immediately adjacent to and preferably abuttingly adjacent to ratchet plate 24. The escapement plate 28 is allowed to move downwardly and rearwardly from the set position shown in FIGS. 1–4, wherein ratchet notches 26 are exposed by slot 29 in escapement plate 28, to a reset position wherein notches 26 are covered by the upper portion of escapement plate 28 when knee section 20 is raised to its uppermost limit as shown in FIG. 7, and back to the position shown in FIGS. 1–4 when knee section 20 is at its lower limit of travel. As shown in FIGS. 2 and 5, fractional washers 45 are preferably disposed on the shank portion of pins 32 and 33 between the escapement plate and the heads of pins 32, 33 to help retain escapement plate 28 in the set and reset positions until the escapement plate is repositioned by clevis pin 37 as described below. Additionally, other frictional arrangements such as a ball and channels arrangement, friction pads, a spring biased ball and socket arrangement, etc., can be provided to help hold the escapement plate in the set or reset positions until the cam edges 40 and 41 are engaged by clevis pin 37.

The ratchet type latch mechanism is operatively connected to knee section 20 by means of crank arms 34 and 35 (FIGS. 2 and 5), and transverse shaft 36. Crank arms 34 and 35 are laterally disposed on opposite sides of the latch mechanism and connected thereto by means of a clevis pin 37 connected to apertures 38 and 39 in crank arms 34 and 35 respectively, and passing through slots 25 and 29 in ratchet plate 24 and escapement plate 28 respectively. Crank arms 34 and 35 are each pivotally mounted for rotation on transverse shaft 36, which is connected to knee section 20.

Elongate slot 29 of escapement plate 28 includes a forward caming surface 40 which is engagable by clevis pin 37 to move escapement plate 28 upwardly from a lower position wherein ratchet notches 26 are covered by an upper portion of the escapement plate to an upper position wherein ratchet notches 26 are exposed and engagable by the clevis pin when the knee section 20 is lowered from an elevated position to cause the clevis pin to move forwardly toward caming surface 40. Escapement plate 28 also includes a rear caming surface 41 which is engagable by clevis pin 37 to move the escapement plate downwardly from a position wherein the ratchet notches are exposed to a position wherein the ratchet notches are covered or overlapped by an upper portion of the escapement plate to prevent engagement of the clevis pin with the ratchet notches when knee section 20 is raised to its maximum limit which causes the clevis pin to move rearwardly toward rear caming surface 41. Knee section 20 is preferably provided with a handle 42 to permit the knee section to be manually raised and pivoted about pivot axis 21 into an elevated position wherein the latch mechanism can maintain the knee section at a selected elevated position by engagement of clevis pin 37 with one of the plurality of ratchet notches 26 of slot 25 of ratchet plate 24.

Figure 6:
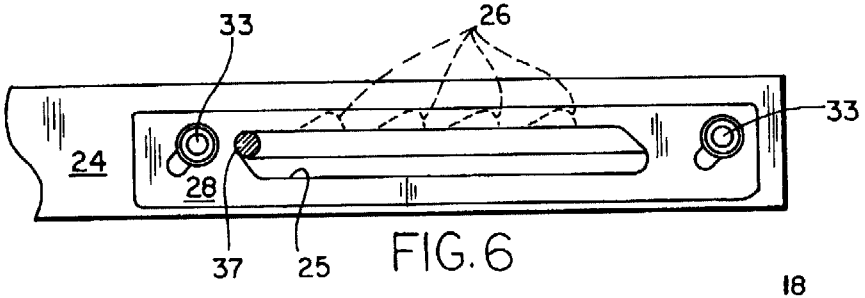
FIG. 6 is an enlarged fragmentary side elevational view of the latch mechanism, showing the escapement plate in the reset position.
Figure 3:
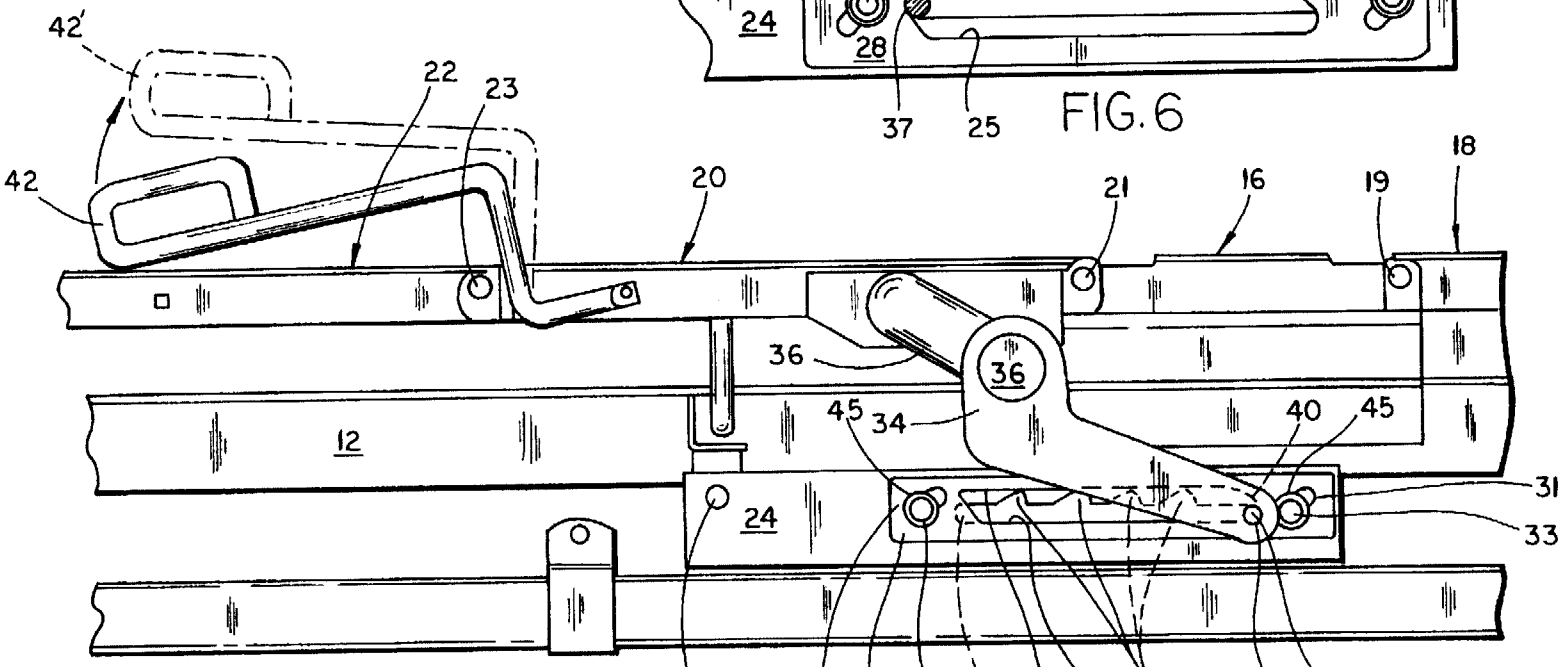
FIG. 3 is an enlarged, fragmentary, side elevational view of the latch mechanism shown in FIG. 1, showing the latch mechanism when the elevatable portion of the articulated bed upon which the latch mechanism operates is in the lowered or prone position.
Figure 4:
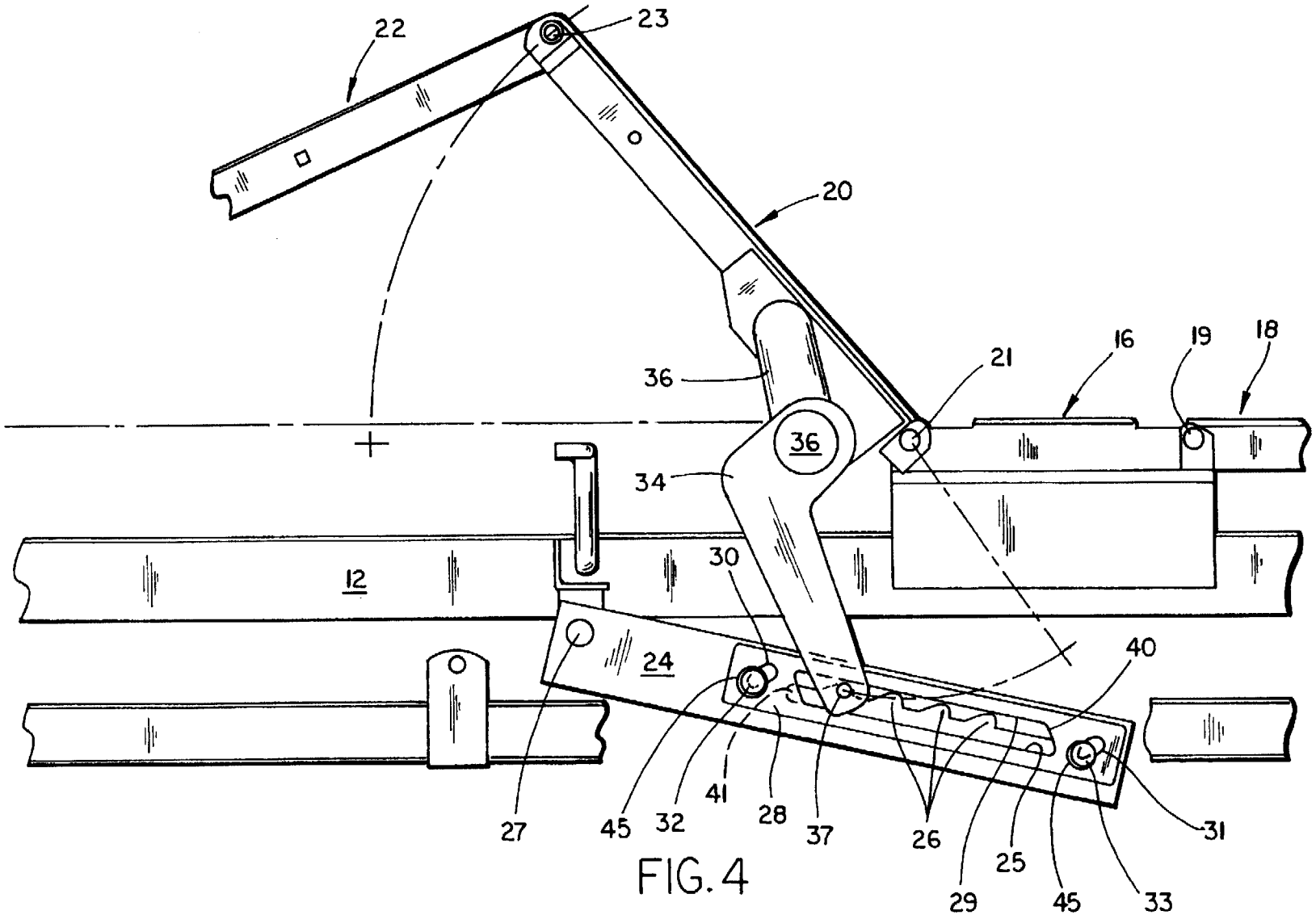
FIG. 4 is an enlarged, fragmentary, side elevational view of the latch mechanism from FIG. 3 when the elevatable portion of the articulated bed upon which the mechanism operates is in a raised or elevated position.

In operation knee section 20 is raised such as by grasping handle 42 and rotating it upwardly. As knee section 20 is rotated upwardly, crank arm 34 rotates about shaft 36 and clevis pin 37 connected to crank arm 34 rotates downwardly and along ratchet slot 25 away from the set position shown in FIG. 3 toward the cam surface 41 at the opposite end of slot 25 such as shown in FIG. 4. As knee section 20 is raised, ratchet plate 24 rotates about pivot point 27, as can be seen by comparing FIGS. 3 and 4. As the knee section 20 is raised and clevis pin 37 moves along slot 25 toward cam surface 41, the clevis pin engages the first ratchet notch 26 closest to cam surface 40. The first notch corresponds to the lowest elevated position at which the latch mechanism can maintain knee section 20. From this position, the knee section 20 can be raised further to engage any of the plurality of notches 26 in slot 25 to maintain knee section 20 at a desired elevated position. FIG. 4 shows the knee section 20 at the maximum elevated position for the illustrated latch mechanism. To lower the knee section 20 from the maximum elevated position, knee section 20 is raised further to move clevis pin 37 past the last notch 26 and toward cam surface 41. As clevis pin 37 engages cam surface 41, escapement plate 28 is urged downwardly (as shown in FIGS. 6 and 7) so that the upper edge thereof covers notches 26 and prevents engagement of clevis pin 37 with notches 26 to allow knee section 20 to be rotated downwardly without interference from notches 26. As knee section 20 is rotated downwardly, clevis pin 37 moves along slots 25 and 29 of ratchet plate 24 and escapement plate 28, respectively, guided by the upper edge of slot 29 and the lower edge of slot 25. When knee section 20 is lowered, clevis pin 37 moves toward an eventually engages cam surface 40 causing escapement plate 28 to move upwardly and re-expose notches 26.

The ratchet type latch mechanism of the invention is relatively simple, so that the components can be easily and inexpensively fabricated and assembled. The latch mechanism requires a relatively short mounting distance as compared with conventional screw type drive mechanisms which are currently used, and provides a simpler, easier to use mechanism which allows rapid repositioning of a pivotable portion of an articulated structure to maintain the same at a desired elevated position relative to a frame on which the elavatable portion is mounted. The mechanism can also be easily retrofitted with existing positioner designs for adjustable multi-position care beds and the like.

The embodiments of the invention in which an exclusive property or privilege is claimed are defined as follows:

1. An articulated structure comprising:

a frame having a fixed portion and a movable portion pivotally connected therewith;

a ratchet plate pivotally mounted to the stationary portion of said frame, said ratchet plate having an elongate ratchet slot with a plurality of longitudinally spaced ratchet notches;

an escapement plate slidably mounted to said rachet plate, and having an elongate slot generally overlying said ratchet slot with first and second cam surfaces adjacent opposite ends thereof, said escapement plate being movable with respect to said rachet plate between a set position wherein said ratchet notches are exposed by the elongate slot of said escapement plate and a reset position wherein said ratchet notches are covered by said escapement plate; and a crank arm mounted to the movable portion of said frame, said crank arm having a clevis pin projecting through said ratchet slot in said ratchet plate and through said slot in said escapement plate, and being engagable with said first cam surface to move said escapement plate to said set position wherein said ratchet notches are exposed when the movable portion of said frame is lowered, and being engagable with said second cam surface to move said escapement plate to said reset position wherein said ratchet notches are covered by said escapement plate when the movable portion of said frame is raised.

2. The structure of claim 1, including a friction retainer operably engaging said ratchet plate and said escapement plate, and retaining said escapement plate in a selected one of said set and rest positions.

3. The structure of claim 2, wherein one of said ratchet and escapement plates includes first and second retainer pins projecting adjacent opposite ends thereof, and the other of said ratchet and escapement plates includes first and second short slots positioned to receive said first and second retainer pins therethrough to slidably interconnect said ratchet and said escapement plate.

4. The structure of claim 3, wherein said short slots are disposed at a first angle with respect to the longitudinal direction of said ratchet slot, and said cam surfaces are disposed at an angle with respect to said longitudinal direction of said ratchet slot which is opposite said first angle to permit lateral shifting of said escapement plate between the set and reset positions.

5. The structure of claim 4, wherein the width of the elongate slot of the escapement plate is about equal to the maximum width of said ratchet slot as measured from a lower side of said ratchet slot to an upper extremity of one of said ratchet notches.

6. The structure of claim 5, wherein said escapement plate includes said short slots through which the retainer pins pass, the limits of movability of said escapement plate with respect to said ratchet plate being defined by said short slots.

7. The structure of claim 6, further comprising a second crank arm, said crank arms being laterally disposed on opposite sides of the ratchet plate and the escapement plate, each of said crank arms being rotatably mounted to a shaft connected on said pivotable portion of said structure, and said clevis pin being connected to each of said crank arms and passing through said elongate slot in said escapement plate and said elongate slot in said ratchet plate.

8. An articulated bed or the like, comprising:

a frame having a fixed portion and a movable portion pivotally connected therewith;

a ratchet plate pivotally mounted to the stationary portion of said frame, and having an elongate ratchet slot with a plurality of longitudinally spaced ratchet notches;

an escapement plate slidably mounted to said ratchet plate and having an elongate slot generally overlying said ratchet slot with first and second cam surfaces adjacent opposite ends thereof;

said escapement plate being movable with respect to said ratchet plate between a set position wherein said ratchet notches are exposed through the elongate slot of said escapement plate, and a reset position wherein said ratchet notches are covered by said escapement plate;

a crank arm mounted to the movable portion of said frame and pivoting therewith; and said crank arm having a clevis pin projecting through said ratchet slot in said ratchet plate and through said slot in said escapement plate, and being engagable with said first cam surface to move said escapement plate to said set position wherein said ratchet notches are exposed when the movable portion of said frame is lowered, and being engagable with said second cam surface to move said escapement plate to said reset position wherein said ratchet notches are covered by said escapement plate when the movable portion of said frame is raised.

9. The structure of claim 8, including a friction retainer operable engaging said ratchet plate and said escapement plate, and retaining said escapement plate in a selected one of said set and reset positions.

10. The structure of claim 9, wherein one of said ratchet and escapement plates includes first and second retainer pins projecting adjacent opposite ends thereof, and the other of said ratchet and escapement plates includes first and second short slots positioned to receive said first and second retainer pins therethrough to slidably interconnect said ratchet and said escapement plate.

11. The structure of claim 10, wherein said short slots are disposed at a first angle with respect to the longitudinal direction of said ratchet slot, and said cam surfaces are disposed at an angle with respect to said longitudinal direction of said ratchet slot which is opposite said first angle to permit lateral shifting of said escapement plate between the set and reset positions.

12. The structure of claim 11, wherein the width of the elongate slot of the escapement plate is about equal to the maximum width of said ratchet slot as measured from a lower side of said ratchet slot to in upper extremity of one of said ratchet notches.

13. The structure of claim 12, wherein said escapement plate includes the short slots through which the retainer pins pass, the limits of movability of said escapement plate with respect to said ratchet plate being defined by said short slots.

14. The structure of claim 13, further comprising a second crank arm, said crank arms being laterally disposed on opposite sides of the ratchet plate and the escapement plate, each of said crank arms being rotably mounted to a shaft connected on said pivotable portion of said structure, and said clevis pin being connected to each of said crank arms and passing through said elongate slot in said escapement plate and said elongate slot in said ratchet plate.

15. An articulated bed or the like including a frame having a fixed portion and a movable portion pivotally connected therewith, said frame having a pivotal mount for attaching one end of a drive mechanism thereto, said movable portion having a pivotal mount for attaching another end of a drive mechanism thereto, the improvement comprising a manually operable ratchet type latch mechanism for maintaining the movable portion of said articulated bed in an elevated position relative to said stationary portion, said ratchet type latch mechanism being operably attached to said pivotal mounts, whereby an articulated bed adapted for use with a drive mechanism is provided with a manually operable latch type ratchet mechanism.

16. The bed of claim 15, wherein said ratchet type latch mechanism comprises:

a ratchet plate pivotally mounted to the stationary portion of said frame, and having an elongate ratchet slot with a plurality of longitudinally spaced ratchet notches;

an escapement plate slidably mounted to said ratchet plate and having an elongate slot generally overlying said ratchet slot with first and second cam surfaces adjacent opposite ends thereof;

said escapement plate being movable with respect to said ratchet plate between a set position wherein said ratchet notches are exposed through the elongate slot of said escapement plate, and a reset position wherein said ratchet notches are covered by said escapement plate;

a crank arm mounted to the movable portion of said frame and pivoting therewith;

said crank arm having a clevis pin projecting through said ratchet slot in said ratchet plate and through said slot in said escapement plate, and being engagable with said first cam surface to move said escapement plate to said set position wherein said ratchet notches are exposed when the movable portion of said frame is lowered, and being engagable with said second cam surface to move said escapement plate to said reset position wherein said ratchet notches are covered by said escapement plate when the movable portion of said frame is raised.

17. The bed of claim 16, including a friction retainer operably engaging said ratchet plate and said escapement plate, and retaining said escapement plate in a selected one of said set and reset positions.

18. The bed of claim 17, wherein one of said ratchet and escapement plates includes first and second retainer pins projecting adjacent opposite ends thereof, and the other of said ratchet and escapement plates includes first and second short slots positioned to receive said first and second retainer pins therethrough to slidably interconnect said ratchet and said escapement plate.

19. The bed of claim 18, wherein said short slots are disposed at a first angle with respect to the longitudinal direction of said ratchet slot, and said cam surfaces are disposed at an angle with respect to said longitudinal direction of said ratchet slot which is opposite said first angle to permit lateral shifting of said escapement plate between the set and reset positions.

20. An articulated bed or the like, comprising:

a frame having a fixed portion and a movable portion pivotally connected therewith;

a ratchet plate pivotally mounted to the stationary portion of said frame, and having an elongate ratchet slot with a plurality of longitudinally spaced ratchet notches;

an escapement plate slidable mounted to said ratchet plate, and having an elongate slot generally overlying said ratchet slot, said escapement plate being movable with respect to said ratchet plate between a set position wherein said ratchet notches are exposed through the elongate slot of said escapement plate, and a reset position wherein said ratchet notches are covered by said escapement plate; and a crank arm mounted to the movable portion of said frame and pivoting therewith; and said crank arm having a pin projecting through said ratchet slot in said ratchet plate and through said slot in said escapement plate, said pin being engagable with said notches when said escapement plate to in the set position and isolated from said notches when said escapement plate is in the reset position.

* * * * *